US009347270B2

(12) United States Patent
Shafer et al.

(10) Patent No.: US 9,347,270 B2
(45) Date of Patent: May 24, 2016

(54) PRE-POSITIONED CAPPING DEVICE AND DIVERTER

(71) Applicant: CONOCOPHILLIPS COMPANY, Houston, TX (US)

(72) Inventors: Randall S. Shafer, Houston, TX (US); Graham Alvord, Anchorage, AK (US); Rune Woie, Stavanger (NO)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 14/312,891

(22) Filed: Jun. 24, 2014

(65) Prior Publication Data

US 2015/0021037 A1 Jan. 22, 2015

Related U.S. Application Data

(60) Provisional application No. 61/847,895, filed on Jul. 18, 2013.

(51) Int. Cl.

| | |
|---|---|
| ***E21B 33/064*** | (2006.01) |
| ***E21B 33/076*** | (2006.01) |
| ***E21B 34/04*** | (2006.01) |
| ***E21B 43/01*** | (2006.01) |
| ***E21B 33/00*** | (2006.01) |
| ***E21B 7/12*** | (2006.01) |

(52) U.S. Cl.

CPC ..... *E21B 7/12* (2013.01); *E21B 33/064* (2013.01); *E21B 43/0122* (2013.01)

(58) Field of Classification Search

USPC ..... 166/347, 363, 368; 405/224

See application file for complete search history.

(56) References Cited

U.S. PATENT DOCUMENTS

| | | | | |
|---|---|---|---|---|
| 4,507,017 | A * | 3/1985 | Magoon | E02B 15/08 405/66 |
| 5,197,826 | A * | 3/1993 | Korloo | E21B 41/0071 405/195.1 |
| 5,407,172 | A | 4/1995 | Young et al. | |
| 7,779,917 | B2 | 8/2010 | Kotria et al. | |
| 8,033,335 | B2 | 10/2011 | Orbell et al. | |
| 8,136,598 | B2 | 3/2012 | Kotria et al. | |
| 8,413,716 | B2 | 4/2013 | Judge et al. | |
| 9,033,049 | B2 * | 5/2015 | Kotrla | E21B 33/0355 166/338 |
| 2012/0018165 | A1 * | 1/2012 | Crossley | E21B 33/037 166/344 |
| 2012/0085543 | A1 | 4/2012 | Redden et al. | |

(Continued)

OTHER PUBLICATIONS

Wang, C., Quah, M., Noble, P. G., Shafer, R., Soofi, K. A., Alvord, C., & Brassfield, T. (Dec. 3, 2012). Use of Jack-up Drilling Units in Arctic Seas with Potential Ice Incursions during Open Water Season. Offshore Technology Conference. doi:10.4043/23745-MS.

(Continued)

*Primary Examiner* — Matthew R Buck
*Assistant Examiner* — Douglas S Wood
(74) *Attorney, Agent, or Firm* — ConocoPhillips Company

(57) ABSTRACT

Systems and methods contain fluids discharged from a subsea well or at the surface by capping the well blowout with a pre-positioned capping device and diverting flow of hydrocarbons to a secondary location for disposal/handling in situations where casing integrity is compromised preventing ability to close in the flow of the hydrocarbons. The capping device includes at least one blind shear ram and is separate from a blowout preventer. Different personnel offsite of a rig drilling the well may have access and control to operate the device.

20 Claims, 3 Drawing Sheets

(56) References Cited

U.S. PATENT DOCUMENTS

2012/0197527 A1 8/2012 McKay et al.
2012/0318520 A1* 12/2012 Lugo ..... E21B 21/001
166/363

OTHER PUBLICATIONS

International Search Report. PCY/US2014/043886. Dated Nov. 3, 2014.

* cited by examiner

PRE-POSITIONED CAPPING DEVICE AND DIVERTER

CROSS-REFERENCE TO RELATED APPLICATIONS

This application is a non-provisional application which claims benefit under 35 USC §119(e) of and priority to U.S. Provisional Application Ser. No. 61/847,895 filed 18 Jul. 2013, entitled "PRE-POSITIONED CAPPING DEVICE FOR SOURCE CONTROL WITH INDEPENDENT MANAGEMENT SYSTEM," which is incorporated by reference herein in its entirety.

FIELD OF THE INVENTION

Embodiments of the invention relate generally to systems and methods for containing fluids discharged from a subsea well or at the surface.

BACKGROUND OF THE INVENTION

In offshore floating drilling operations, a blowout preventer (BOP) can be installed on a wellhead at the sea floor and a lower marine riser package (LMRP) mounted to the BOP. In addition, a drilling riser extends from a flex joint at the upper end of LMRP to a drilling vessel or rig at the sea surface. A drill string is then suspended from the rig through the drilling riser, LMRP, and the BOP into the wellbore. A choke line and a kill line also suspend from the rig and couple to the BOP, usually as part of the drilling riser assembly.

Another type of offshore drilling unit is a jack-up unit, which may include a BOP at the surface located on the unit. The jack-up unit can drill with a subsea wellhead on the seabed, a high pressure riser up to the jack-up unit, and the surface BOP connected to the high pressure riser. Offshore drilling can also be done from an offshore platform, a piled structure, a gravity based structure, or other permanent type structure. These drilling operations may use a surface BOP.

During drilling operations, drilling fluid, or mud, is delivered through the drill string and returned up an annulus between the drill string and casing that lines the well bore. In the event of a rapid influx of formation fluid into the annulus, commonly known as a "kick," the BOP may be actuated to seal the annulus and control the well. In particular, BOP's include closure members capable of sealing and closing the well in order to prevent release of high-pressure gas or liquids from the well. Thus, the BOP's are used as safety devices to close, isolate, and seal the wellbore. Heavier drilling mud may be delivered through the drill string, forcing fluid from the annulus through the choke line or kill line to protect the well equipment disposed above the BOP from the high pressures associated with the formation fluid. Assuming the structural integrity of the well has not been compromised, drilling operations may resume. However, if drilling operations cannot be resumed, cement or heavier drilling mud is delivered into the well bore to kill the well.

In the event the BOP fails to actuate, or insufficiently actuates, in response to a surge of formation fluid pressure in the annulus, a blowout may occur. Containing and capping the blowout may present challenges since the wellhead may be hundreds or thousands of feet below the sea surface and, with surface BOP's, the flow presents a great danger of fire or explosion. Personnel are forced to evacuate the drilling unit if a well blows out as it is very dangerous.

Accordingly, there remains a need in the art for systems and methods to cap a well quickly to stop flow. Such systems and methods would be particularly well-received if they offered the potential to cap a well discharging hydrocarbon fluids almost immediately. This would reduce potential environmental damage and danger to personnel and the drilling unit.

Well capping subsea is an involved process. The floating drilling unit may have been damaged, even sunk, on location. Debris from the drilling unit has to be cleared from the wellsite. Preparations involve injecting dispersants subsea into the blowout to disperse oil and gas in the water column. This dispersion then allows vessels with debris removal equipment to clear the area around the BOP. Once this area is cleared, another vessel can install the capping stack and shut in the well. This process can take 10 to 21 days with uncontrolled well flow to the environment. Complexness of this operation may require five or more large vessels.

Well capping with a surface BOP offshore, jack-up or platform takes a similar time period. During the capping operation the danger of fire and explosion is always present. If fire or explosion does occur, the platform or jack-up can be a complete loss. If the platform has multiple wells, all the wells can blowout. To ensure fire or explosion does not occur, the drilling unit must be deluged with water from several vessels at a high rate. Once deemed safe, personnel inspect the surface BOP and determine how the well can be capped. Debris is cleared by personnel, and BOP equipment is examined. During this period, the deluge from vessels continues and the well flows to the environment. A plan is determined, and the well is capped.

SUMMARY OF THE INVENTION

In an embodiment, a pre-positioned capping and diverter assembly includes at least one blind shear ram disposed between a wellhead and a blowout preventer stack. A control system sends wellbore data offsite of a rig coupled for drilling through the wellhead and actuates the ram without use of the rig upon receiving command signals from offsite of the rig. A conduit couples to receive flow from the wellhead and output the flow to a location offset in a lateral direction from the rig with the ram actuated to close a fluid pathway to the rig.

For another embodiment, a method of controlling a well includes disposing a pre-positioned capping device and a blowout preventer stack on a wellhead and coupling an outlet of the capping device to a conduit extending to a location offset in a lateral direction from the rig such that flow diverts to the location upon closing a blind shear ram of the capping device. Drilling the well using the rig occurs through the blowout preventer stack and the capping device coupled to the conduit. The method further includes receiving wellbore data with a control system disposed offsite of the rig and operated by a person not part of rig personnel and controlling the ram of the capping device via command signals sent from the control system to the capping device.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Reference will now be made in detail to embodiments of the present invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used in another embodiment to yield a still further embodiment. Thus, it is intended that the present invention cover such modifications and variations that come within the scope of the appended claims and their equivalents.

By way of explanation and not by way of limitation, the following description focuses on subsea pre-positioned capping device (PCD) used with a jack-up drilling unit. However, it is to be clearly understood that the principles of the present invention are not limited to environments as described herein. Thus, the use of the PCD on a jack-up drilling unit is described herein as merely an example of the wide variety of uses for the principles of the present invention. The PCD can be used with a subsea BOP or any surface BOP with location being subsea, on a lower level below the BOP, or positioned immediately below the BOP.

Figure 1:
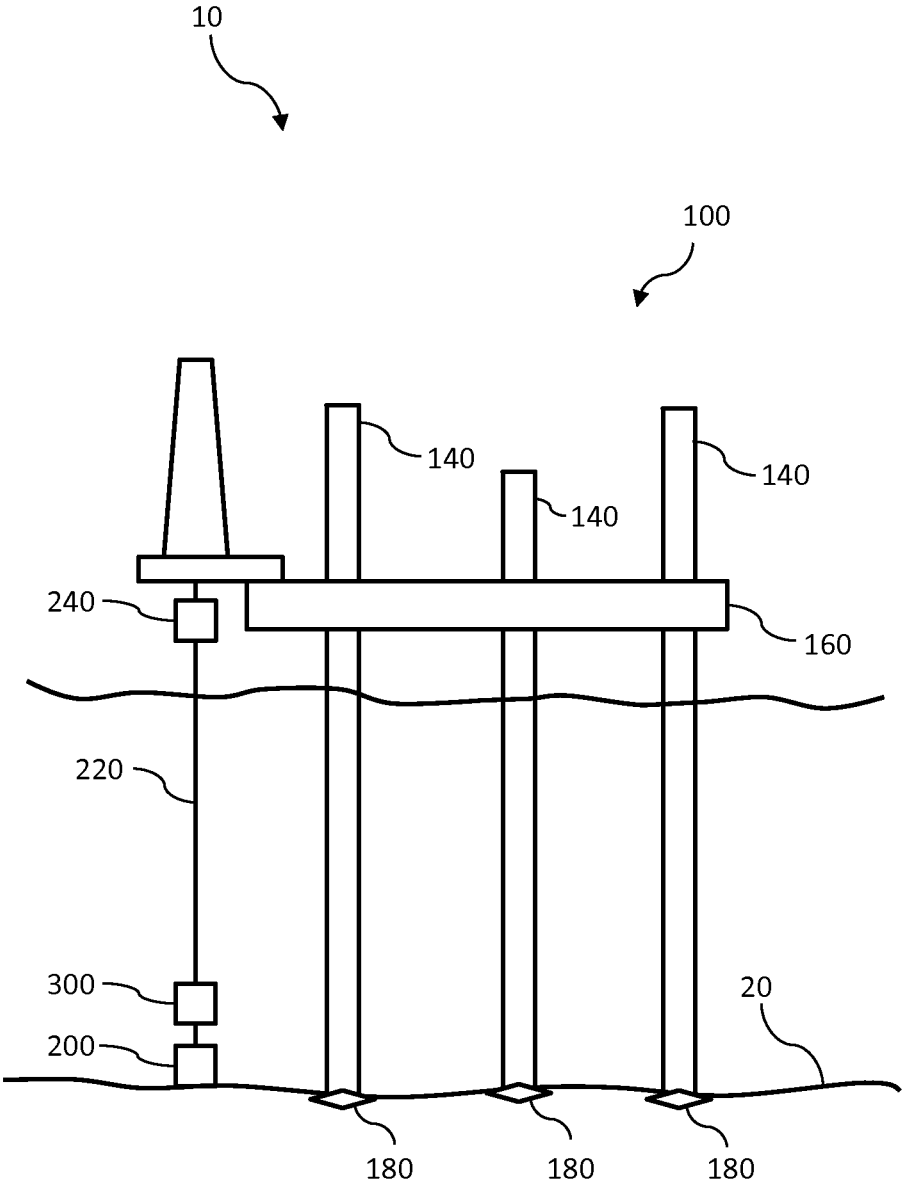
FIG. 1 is a schematic diagram illustrating a jack-up drilling rig unit in accordance with an embodiment of the present invention.

FIG. 1 illustrates a jack-up drilling rig unit 10 depicted with a jack-up rig 100 resting on the sea-bed 20. The jack-up rig 100 is a type of mobile platform including a buoyant hull 160 fitted with a number of movable legs 140, capable of raising the hull 160 over the surface of the sea. The buoyant hull 160 enables transportation of the unit 10 and all attached machinery to a desired location. Once on location, the hull 160 raises to the required elevation above the sea-bed 20 surface on its legs 140 supported by the sea-bed 20.

The legs 140 of such units may be designed to penetrate the sea-bed 20, may be fitted with enlarged sections or footings, or may be attached to a bottom mat. Footings or spudcans 180 spread the load so the rig 100 does not sink into the sea-bed 20. The base of each leg 140 is fitted with a spudcan 180, which may include a plate or dish designed to spread the load and prevent over penetration of the leg 140 into the sea-bed 20. The spudcans 180 may be circular, square or polygonal.

A high pressure riser 220 leads to the wellhead 200 in the sea-bed 20. The high pressure riser 220 may be a thick walled, high strength riser and can contain full well pressure. A surface blowout preventer (BOP) stack 240 is located on the jack-up rig 100. The PCD 300 is pre-installed on the wellhead 200.

The PCD 300 functions as an independent safety and containment device for well leakage and/or blowout. The PCD 300 is installed on the well when the BOP stack 240 is installed and is a safety device to be used if the drilling unit's BOP stack 240 fails to control a well blowout. When necessary, the PCD 300 is activated immediately to regain control of the well leak or blowout providing a secondary level of environmental and personnel protection. The PCD 300 can additionally function to secure the well by closure of the PCD 300 if the rig must be moved.

Figure 2:
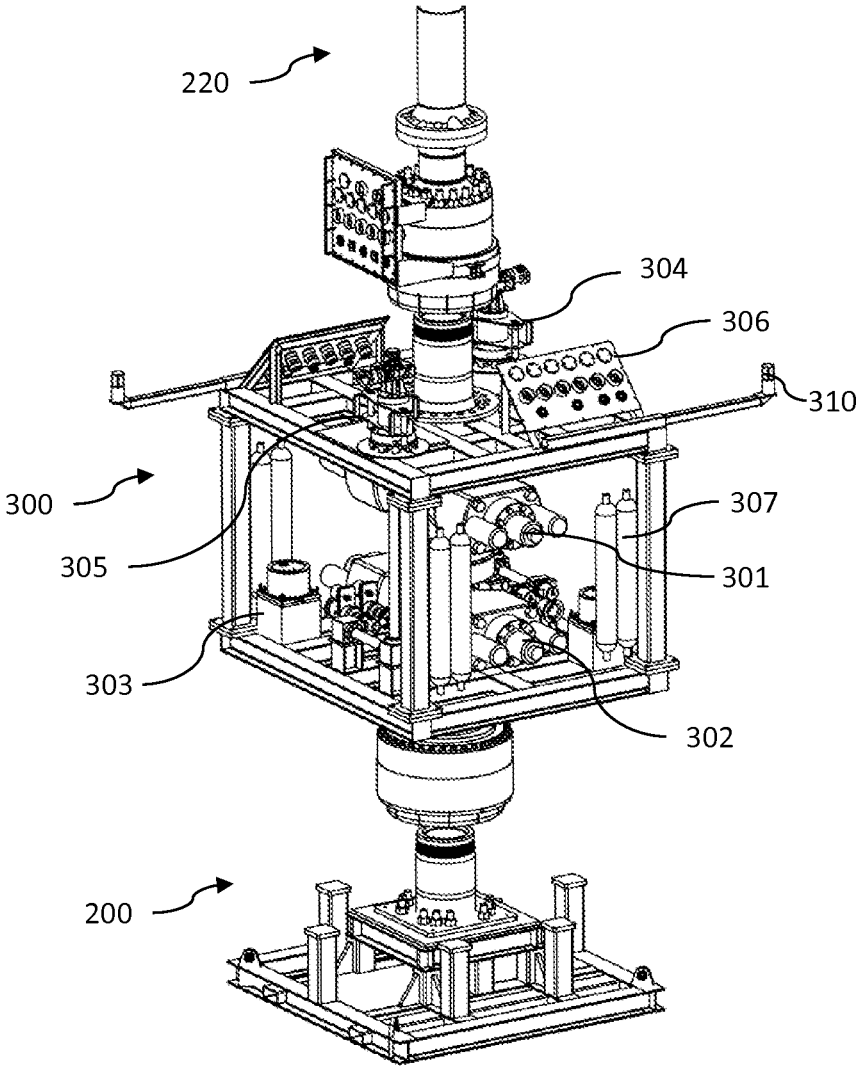
FIG. 2 is a schematic diagram illustrating a pre-positioned capping device attached to a wellhead in accordance with an embodiment of the present invention.

FIG. 2 shows the PCD 300 designed for attachment onto substantially any wellbore worldwide and for functioning in subsea and surface operations. The PCD 300 forms a capping stack, which may include a first blind shear ram 301, a second blind shear ram 302, a power source 307 for closing the rams 301, 302 and that is independent from the rig 100 and an independent control system 303. The power source 307 (e.g., pressurized tanks with hydraulic fluid) of the PCD 300 provides stored power to the control system 303 and as otherwise necessary for actuation of the PCD 300 without relying on power from the rig 100. Since the power source 307 may form an integral component of the PCD 300 and be disposed remote from the rig 100, collocation of the power source 307 with the blind shear rams 301, 302 enables operability without relying on hydraulic pressure supplied from the rig 100.

The blind shear rams 301, 302 (also known as shear seal rams, or sealing shear rams) seal the wellbore, even when the bore is occupied by a drill string, by cutting through the drill string as the rams 301, 302 close off the well. The upper portion of the severed drill string is freed from the ram 301, 302, while the lower portion may be crimped and the "fish tail" captured to hang the drill string. For some embodiments, the independent control system 303 for the PCD 300 may not actuate the rams 301, 302 during normal drilling or kick occurrences handled by the BOP stack 240 but rather only upon the independent control system 303 being operated for loss of control for which the BOP stack 240 does not or cannot regain control.

The PCD 300 may further include at least one pressure and/or temperature transducer below each ram 301, 302 capable of analogue local display. The PCD 300 may have a number of outlets 304. Each outlet may be provided with two hydraulically controlled gate valves. Two of the outlets may be equipped with manually controlled chokes to perform soft shut-in of the second blind shear ram 302. The capping stack may also include an inlet 305 to inject glycol or methanol to mitigate hydrate formation.

Figure 3:
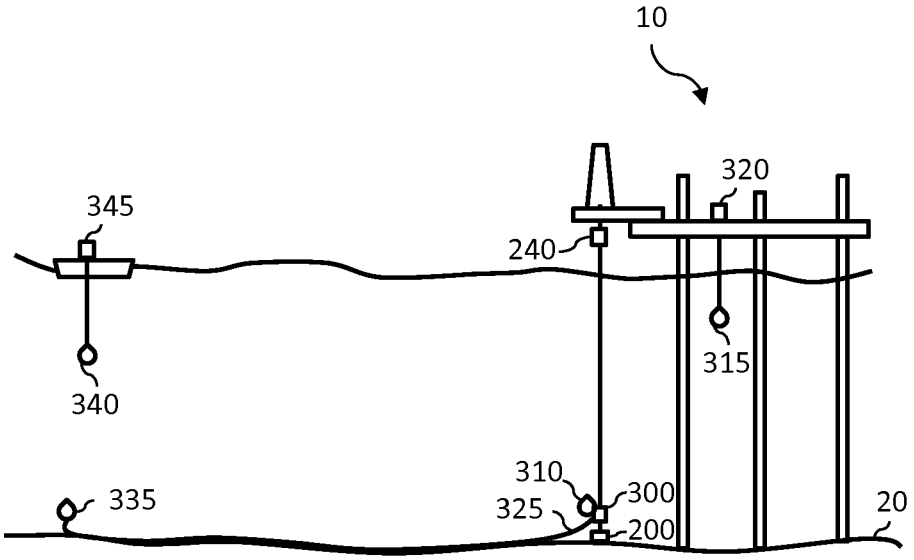
FIG. 3 is a schematic diagram illustrating control of the pre-positioned capping device in accordance with an embodiment of the present invention.

As described in further detail with respect to FIG. 3, the independent control system 303 activates the PCD 300 independent from activation of the BOP stack 240 and can be operated by the drilling rig unit 10 or from a vessel or other installation remote from the drilling rig unit 10. For some embodiments, the control system 303 includes a self-contained electrical supply, such as a battery, for any functions of the control system 303 described herein and utilizing current independent of the drilling rig unit 10. In some embodiments, the independent control system 303 may form part of a digital acoustic control system. The digital acoustic control system may utilize low frequency sound sent to, or received from, the control system 303 on the PCD 300.

FIG. 3 depicts two digital acoustic control systems. The digital acoustic control system on the drilling rig unit 10 includes a rig transducer 315 disposed in the water and coupled to a rig user interface station 320, which may be operated by the drilling crew or the operator supervisor on the drilling rig unit 10. The digital acoustic control system on a vessel near the drilling location includes an auxiliary transducer 340 coupled to an auxiliary user interface station 345, which may be operated by a well control representative. As used herein, an independent management system refers to the auxiliary user interface station 345 with the well control representative not being managed by the drilling crew operating the rig user interface station 320. For some embodiments, the auxiliary user interface station 345 functions concurrent with the rig user interface station 320 for possible actuation of the PCD 300 if needed.

The PCD 300 having this independent management system ensures that decisions are made in a timely manner to prevent a major blowout and harm to personnel. Personnel directly involved in the well blowout on the installation, and which perhaps caused it, may not manage the PCD 300. Independent systems from the drilling rig unit 10 mean that in the event of a large fire/explosion on the drilling rig unit 10 the PCD 300 can still be activated to protect personnel and the environment. As previously mentioned, the PCD 300 may be implemented in numerous cases, including: (1) failure of the well control system on the drilling rig unit 10; (2) management system failure on the drilling rig unit 10; or (3) fire or explosion on the drilling rig unit 10 that prevents operation or continued operation, i.e., loss of hydraulic pressure on some function, of other well control systems, such as the BOP stack 240.

In operation, signals from the rig transducer 315 or the auxiliary transducer 340 to a PCD transducer 310 or a remote transducer 335 provide command signals to the control system 303 for functioning of the PCD 300. Both the PCD transducer 310 and the remote transducer 335 connect to the control system 303. The remote transducer 335 may connect to the PCD 300 by a cable 325 of sufficient length (e.g., 150 meters) to enable placement of the remote transducer 335 away from the PCD transducer 310 proximate the PCD 300. The remote transducer 335 thus may facilitate communicating with PCD 300 should access to the drilling rig unit 10 be restricted. Acoustic data transmission may also be sent from the PCD 300 to the surface via the transducers 310, 315, 335, 340 to monitor the system status and wellbore conditions (e.g., pressure and/or temperature measured by the transducers of the PCD 300).

While the digital acoustic control system functions as the primary PCD control system, a secondary interface may also be utilized. In an embodiment, a remotely operated vehicle (ROV) may be utilized as a secondary PCD control system with the ROV providing physical input direct to the PCD 300 through an ROV control panel 306. The ROV control panel 306 may send a signal to the control system 303 of the PCD 300 that operates valves sending hydraulic pressure from the power source 307 to operate the blind shear rams 301, 302.

PCD systems on the surface have independent controls also. Examples of such independent controls include wireless controls or shielded fiber optics, cable, or piping. Regardless of signal interface techniques employed, the independent controls enable operation of the PCD systems independent from BOP control systems.

In some embodiments, the PCD facilitates capping a well almost immediately. This quick response time reduces the chance of fire or explosion endangering personnel or even sinking the drilling unit or complete loss of a fixed platform. The blowout oil spill volume is greatly reduced as the flow duration is minutes instead of weeks reducing the potential for environmental damage.

There are no issues with installing the system since the PCD is preinstalled. A conventional capping stack, which is installed after a blowout, could encounter a situation where debris prevents installation. The PCD also prevents the situation where the drilling unit or platform collapses on a well due to fire and/or explosion. In this case, the blowout could not be capped with a capping stack due to debris or damage to the BOP and/or wellhead.

The PCD with independent power can be operated even with significant damage to the drilling unit. The drilling unit's BOP might have failed due to loss of power but this would not impact the PCD. The PCD may include redundant blind shear rams in case one ram fails to shear the drill string and seal the well, but one ram may be sufficient if designed to shear and seal on tubulars used in the well.

Figure 4:
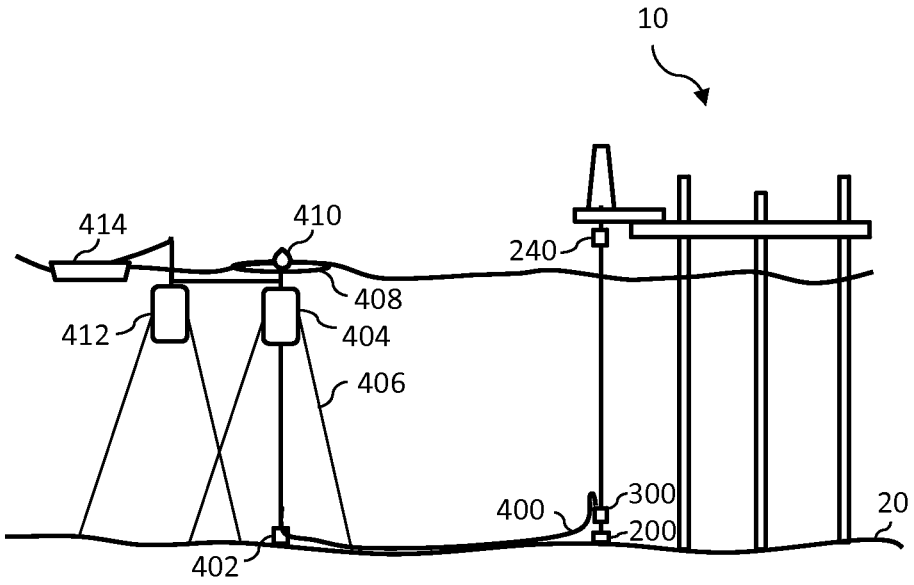
FIG. 4 is a schematic diagram illustrating flow diversion from the pre-positioned capping device to a location away from the rig unit in accordance with an embodiment of the present invention.

FIG. 4 illustrates use of a capping and diverter assembly with a conduit 400 for flow diversion from the PCD 300 to a location away from the drilling rig unit 10. Ability of the PCD 300 to close the well depends on integrity of the well casing and extent of pressure in the well. If casing integrity is lost, formation hydrocarbons may flow outside the casing bypassing a fluid pathway through the wellhead 200. The hydrocarbons coming from the seabed 20 create environmental problems and endanger personnel and the drilling rig unit 10 since the hydrocarbons leak under or in direct proximity of the drilling rig unit 10.

For some embodiments, the conduit 400 and some or all associated components shown in FIG. 4 may be pre-positioned and coupled together during drilling such that in the event of an emergency no delay or installation issues are encountered with respect to operations described herein. Use of the PCD 300 coupled to the conduit 400 to divert the hydrocarbons eliminates or at least limits flow of the hydrocarbons to the seabed 20 at the wellhead 200. Diverting the hydrocarbons from around the drilling rig unit 10 enables the drilling unit rig 10 to be boarded and problems corrected to secure the well using the drilling rig unit 10.

The capping and diverter assembly includes the conduit 400 coupled to the outlet 304 (shown in FIG. 2) of the PCD 300 and extending in a lateral direction away from the wellhead 200, and hence the drilling rig unit 10, a distance of at least 250 meters or at least 500 meters. Part of the conduit 400 may form a riser section to take the hydrocarbons to above a sea surface for facilitating disposal/processing. In some embodiments, a portion of the conduit 400 lays on the seabed 20 between the PCD 300 and a weight 402.

The riser section of the conduit 400 extends upward from the weight 402 toward a buoy 404. Mooring lines 406 from the buoy 404 anchor to the seabed 20 and secure the buoy 404 in location above the weight 402. In some embodiments, an end of the conduit 400 includes a flare 410 for burning the hydrocarbons above the sea surface. A containment boom 408 may secure to the buoy 410 and encircle the sea surface surrounding the flare 410 for limiting the hydrocarbons from floating away from an area of the flare 410.

For some embodiments, an end of the conduit 400 couples to a containment module 414, such as a floating production storage and offloading (FPSO) facility, for holding a quantity of the hydrocarbons flowing from the conduit 400. The containment module 414 may couple to the conduit 400 via a moored and buoyed terminal 412. The containment module 414 captures the hydrocarbons for limiting environmental impacts if the well cannot be repaired or secured for an extended period of time.

In operation, the PCD 300 closes in event of a blowout where the BOP stack 240 does not function to close the well. If the hydrocarbons come to the seabed 20 while the PCD 300 is closed, operating the chokes on the outlet 304 open the flow from the wellhead 200 through the conduit 400. The opening of the chokes continues and may be done in increments until flow ceases coming up through the seabed 20 or at least is reduced and may enable safe work on the drilling rig unit 10. Once the hydrocarbons stop flowing around the drilling rig unit 10, the rig personnel can board the drilling rig unit 10 for operation to correct problems.

Operating the chokes to adjust flow rates may utilize the acoustic control system described herein with respect to FIG. 3 for the PCD 300. In some embodiments, a ROV may also manipulate the choke or be utilized as a secondary controller for backup to the acoustic control system. The chokes may utilize power of the PCD 300 and thus also be operable independent of the drilling rig unit 10.

The flare 410 ignites upon the hydrocarbons being diverted through the conduit 400 by the opening of the chokes. Activation of the PCD 300 and subsequent burning of the hydrocarbons with the flare 410 may occur immediately following an event without delay of bringing in and connecting equipment after the event. Even if not present when the event occurs, the containment module 414 also may require no subsea work, which could be impossible or difficult near the wellhead 200, to couple with the conduit 400 and accept the hydrocarbons diverted due to the event.

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A pre-positioned capping and diverter assembly, comprising:

at least one blind shear ram disposed between a wellhead and a blowout preventer stack;

a control system that sends wellbore data offsite of a platform with a rig coupled for drilling through the wellhead and actuates the ram without use of the platform and rig upon receiving command signals from offsite of the platform and rig;

a conduit coupled to receive flow from the wellhead and output the flow to a location offset in a lateral direction from the platform and rig with the ram actuated to close a fluid pathway to the platform and rig; and a first transducer connected to the control system by a cable and disposed to facilitate receiving the command signals from offsite of the platform and rig should access to the rig be restricted, wherein placement of the first transducer is at a greater distance away from the control system than a second transducer connected to the control system and in communication with a rig controller.

2. The assembly according to claim 1, wherein an outlet of the conduit includes a flare.

3. The assembly according to claim 1, wherein an outlet of the conduit includes a flare maintained at the location by a buoy.

4. The assembly according to claim 1, wherein an outlet of the conduit includes a flare maintained at the location by a buoy with a containment boom surrounding the flare.

5. The assembly according to claim 1, wherein an outlet of the conduit couples to a containment module at the location to hold a quantity of the flow being output.

6. The assembly according to claim 1, wherein the conduit includes a riser to take the flow above a sea surface.

7. The assembly according to claim 1, wherein the conduit includes a riser to take the flow above a sea surface and the riser is coupled at a first end to a weight on a sea floor and is coupled at a second end to a buoy moored to the sea floor.

8. The assembly according to claim 1, wherein the location is offset in the lateral direction from the wellhead by at least 250 meters.

9. The assembly according to claim 1, wherein the location is offset in the lateral direction from the wellhead by at least 500 meters.

10. A method of controlling a well, comprising:

disposing a pre-positioned capping device and a blowout preventer stack on a wellhead;

coupling an outlet of the capping device to a conduit extending to a location offset in a lateral direction from a platform with a rig such that flow diverts to the location upon closing a blind shear ram of the capping device;

drilling the well with the rig through the blowout preventer stack and the capping device coupled to the conduit;

receiving wellbore data with an auxiliary control system disposed offsite of the platform and rig and operated by a person not part of platform and rig personnel; and controlling the ram of the capping device via command signals sent from the auxiliary control system to the capping device, wherein a rig control system communicates with a first transducer proximate and coupled to the pre-positioned capping device, and wherein the auxiliary control system communicates with a second transducer connected to the pre-positioned capping device by a cable and disposed to facilitate communication should access to the rig be restricted due to placement of the second transducer a greater distance away from the pre-positioned capping device than the first transducer.

11. The method according to claim 10, wherein an outlet of the conduit includes a flare.

12. The method according to claim 10, further comprising flaring the flow from an outlet of the conduit maintained at the location by a buoy.

13. The method according to claim 10, wherein an outlet of the conduit includes a flare maintained at the location by a buoy with a containment boom surrounding the flare.

14. The method according to claim 10, further comprising coupling an outlet of the conduit to a containment module at the location to hold a quantity of the flow.

15. The method according to claim 10, further comprising installing a riser to form part of the conduit taking the flow above a sea surface.

16. The method according to claim 10, further comprising installing a riser to form part of the conduit taking the flow above a sea surface by coupling a first end of the riser to a weight on a sea floor and a second end of the riser to a buoy moored to the sea floor.

17. The method according to claim 10, wherein the location is offset in the lateral direction from the wellhead by at least 250 meters.

18. The method according to claim 10, wherein the location is offset in the lateral direction from the wellhead by at least 500 meters.

19. The method according to claim 10, further comprising controlling flow through the conduit once the ram is closed.

20. The method according to claim 10, further comprising increasing the flow through the conduit once the ram is closed until hydrocarbons stop bypassing a pathway through the wellhead.

* * * * *